United States Patent [19]

Standart et al.

[11] 4,021,363

[45] May 3, 1977

[54] MATERIAL FOR IMMOBILIZATION OF TOXIC PARTICULATES

[75] Inventors: Melvin W. Standart, Rancho Cordova; William E. Spargo, Fair Oaks, both of Calif.

[73] Assignee: Aerojet-General Corporation, El Monte, Calif.

[22] Filed: July 22, 1975

[21] Appl. No.: 598,007

[52] U.S. Cl. ..... 252/301.1 W; 206/524.1

[51] Int. Cl.[2] ..... G21F 9/34

[58] Field of Search ..... 252/301.1 W; 424/33; 206/84

[56] References Cited

UNITED STATES PATENTS

| | | | |
|---|---|---|---|
| 3,463,738 | 8/1969 | Fitzgerald et al. | 252/301.1 W |
| 3,625,892 | 12/1971 | Watanabe | 252/8.55 R |

FOREIGN PATENTS OR APPLICATIONS

| | | |
|---|---|---|
| 7,408,700 | 1/1974 | Japan |

*Primary Examiner*—Leland A. Sebastian
*Assistant Examiner*—Deborah L. Kyle
*Attorney, Agent, or Firm*—John S. Bell

[57] ABSTRACT

The immobilization of toxic solids with a mixture of wax and a low molecular weight polyolefin is described herein. In a preferred embodiment, a mixture of between about 60–90% wax and 10–40% of either polyethylene or polypropylene is used to immobilize the low-level radioactive particulate discharged from water treatment in nuclear power plants and similar facilities. This mixture is strong, non-toxic, inexpensive, readily available, easy to handle, and resistant to breakdown, leaching, and combustion. It also mixes well with many different toxic materials. And it will hold up to about four times its weight of a toxic material having a density similar to that of the mixture and a greater weight of more dense materials.

7 Claims, No Drawings

MATERIAL FOR IMMOBILIZATION OF TOXIC PARTICULATES

BACKGROUND OF THE INVENTION

1. Field of the Invention

The handling of toxic materials, and more particularly, the packaging of low-level radioactive waste for storage until radioactivity decays.

2. Brief Description of the Prior Art

There are a number of different toxic particulates that must be packaged in a way that prevents their dispersion. For example, the salts carried by ordinary water become contaminated with radioactive isotopes when the water is used for purposes such as cooling or washing in nuclear power plants and other facilities handling nuclear materials. Radioactivity generally builds to only a relatively low level of about 50 microcuries per cubic centimeter. But, this is sufficiently toxic so the salts must be removed from the water and stored until radioactivity decays. Present water treatment systems remove the salts from the cooling or other water, and then mix them with an immobilization material to prevent dispersion.

The immobilization material should have a high strength and combustion resistance, low solubility in water and other likely leaching agents, be capable of holding large quantities of waste material, and available at low cost. Many different materials, including polyethylene, paraffin wax, cement, ureaformaldehyde, asphalt, and bitumen and various resins have been either tried or considered. But, none of them have been completely satisfactory. Polyethylene chars easily and does not mix well with waste solids. Wax has low strength and burns easily. Cement will hold only a small quantity of waste. Ureaformaldehyde, asphalt, bitumen and the different resins that have been considered, also have varioud drawbacks, including brittleness, the tendency to shrink and crack during cooling or drying, and/or the requirement to control sensitive chemical reactions necessary to make the immobilization material a usable solid.

The use of different additives to overcome some of the undesirable properties of an immobilization material has been considered. For example, it has been suggested to add methyl methacrylate, polypropylene, or polystyrene to improve thermal characteristics of polyethylene. But, these additives have the same problems with charring as polyethylene and thus do not substantially improve its capabilities for mixing with dry toxic solids.

SUMMARY OF THE INVENTION

This invention utilizes a mixture of wax and a polyolefin that can be melted and mixed with the wax without charring. In general, the polyolefins with low molecular weights have less tendency to char than those with a more complicated molecular structure. It is therefore preferred to use a mixture of 60–90% wax and 10–40% of either polyethylene or polypropylene for immobilization of the low-level radioactive salts and other particulate wastes discharged from water treatment installations in nuclear power plants and other facilitates handling nuclear material.

Most polyolefins melt at higher temperatures than waxes. They are also partially soluble in petroleum base waxes heated to temperatures between the melting points of the wax and polyolefin. The preferred mixture can thus be conveniently formed by heating a petroleum base wax to a temperature between its melting point and that of the polyethylene or polypropylene, and then adding the polyethylene or polyolefin to the melted wax. The constituents thus readily melt and mix without charring. The melted mixture then readily accepts large quantities of particulate, and is also strong and resistant to burning and leaching when solidified.

Many water treatment installations designed for use in nuclear facilities discharge sand-grain sized particles at elevated temperatures between about 220°–350° F. The heated particulate is completely dry. And, it consists largely of sodium borate and/or sodium sulphate. Material from immobilizing those solids can be melted in a barrel or other suitable container for storing the radioactive particulate. Toxic solids directed onto the top of the melted mixture will settle down into it, and no complicated mixing apparatus will generally be needed. The mixture can hold up to about four times its weight of solids having densities similar to those of sodium salts, and a greater weight of more dense solids. A dense package of immobilized solids is thus formed when the mixture is allowed to cool and solidify.

DETAILED DESCRIPTION OF THE INVENTION

In further description of this invention wherein a mixture comprising between 60–90% paraffin wax and 10–40% of either polyethylene or polypropylene is preferred for immobilization of low-level radioactive salts, the particular materials used in any embodiment of this mixture may well depend on special requirements of that application. Variation is possible. For example, different percentages of wax and polyolefin can be used. These percentages are preferred because there is a trade-off between the good strength and combustion resistance of polyolefin, and the wetting or mixing properties of wax. The strength and integrity of a package can be increased by increasing the precentages of polyolefin. And, more wax, on the other hand, will make it easier to introduce solid toxics into the mixture.

Many different waxes and polyolefins can also be used. It is preferred to use a wax having melting temperature between about 140°–170° F to immobilize the radioactive salts discharged by water treatment systems in nuclear facilities because those salts are often packaged in barrels and stored in the open at some remote location. Direct sunlight may produce temperatures around 120° F inside the barrels. A wax having a lower melting temperature might melt during storage. Those with higher melting temperatures are hard to melt and mix with the waste initially. The wax may be of either a natural such as a petroleum base, or vegetable base; or other synthetic base. Many examples of each of these waxes melt at appropriate temperatures mix well with many different toxic materials, and are compatible with polyolefins. Petroleum base paraffin waxes are preferred for this example because they are slightly better solvents for polyethylene and polypropylene than the other waxes.

As for the polyolefin, those with relatively low molecular weights and low melting temperatures around, say, 250° F, are preferred because they are easiest to melt without charring. The polyethylenes and polypropylenes have these characteristics. Tests have been conducted and good results obtained during the development of this invention with both low density polethylenes (molecular weight 2000–5000 grams per mole), a high density polyethylenes (molecular weight above 6,000 grams per mole), and the polypropylenes. The high density polyethylenes tested were linear because they were on hand, but cross-linked polyethylenes will also work. Mixtures of these materials with molecular weight within these ranges will melt at about 200°–220° F because of the solubility of wax with polyethylene and polypropylene. This solubility thus helps to prevent risk of charring.

The wax-polyolefin mixture described can be used to immobilize many different radioactive and non-radioactive toxic materials. The toxic materials should be dry when added though, because water will steam of foam a liquefied mixture of wax and polyolefin, and thus prevent formation of a dense package containing substantial quantities of solid particles. The solids should also be preheated. A temperature between about 200°–350° F is preferred when they are to be added to a mixture of a wax having a melting temperature between 140°–170° F and a polyethylene or polypropylene having a melting temperature around 250° F. When the salts are cooler than this, they tend to solidify the surface of the immobilization material before any substantial quantities can be inserted. Particles at a higher temperature tend to char the polyolefin.

No special processing is required for use of this mixture to immobilize the low-level radioactive particulate discharged by many water treatment systems because those systems dry the salts and other particles and discharge them at temperatures between 200°–350° F. The material being immobilized must also be chemically compatible with the wax and polyolefin, but most solids that are either toxic or likely to become so, are compatible with these materials. The toxic solids can be of any size, but mechanical mixing may be needed for small dust-size particles having insufficient weight for gravity settling. If the material being immobilized is toxic by reason of radioactivity, it should not be added to a mixture of wax and either polyethylene or polypropylene for storage in a closed container if the radiation level is high, say above 100 uc/cc or so. When radiation exceeds this level, there are sufficient number and energy of radioactive decay particles for likelihood of release of hydrogen atoms from the hydrocarbon molecules. Hydrogen buildup could be an explosive hazard.

Various additives can also be used to adjust the properties of this immobilization mixture. Experiments have been conducted with PBNA as an anti-oxidant and TCP for vapor pressure depressant. Additions of about 1% by weight of tri-creosolephosphate and phenol-beta-naptha-amine to act respectively as an anti-oxidant and vapor pressure depressant have been made with good results in tests. But, these additives are, themselves, toxic and this require very careful handling prior to incorporation into the immobilization material. They are also expensive. It therefore may well be preferred to use a pure wax-polyolefin mixture without additives in many applications.

Having thus described one embodiment and variations of the invention, what is claimed is:

1. A package for long-term storage of low radiation level particulate comprising:

an outer housing;

a monolithic mass of a non-toxic mixture of natural wax and a polyolefin having a sufficiently low molecular weight to not char at the melting temperature of the mixture disposed within said housing; and low radiation level radioactive particulate solids dispersed in said monolithic mixture such that said solids are encapsulated and immobilized by said monolithic mixture.

2. The package of claim 1 in which:

said mixture comprises approximately 60–90% natural wax and 10–40% of either polyethylene or polypropylene; and said radioactive particulate has a radiation level below about 100 microcuries per cubic centimeter.

3. The package of claim 2 in which:

said wax has a melting temperature between about 140° F;

said polyethylene or polypropylene has a melting temperature below about 250° F; and said mixture of wax and polyolefin forms only about 20% weight of the portion of the package, excluding said housing.

4. The package of claim 3 in which:

said wax comprises a petroleum base paraffin wax; and the mixture further includes anti-oxidant and vapor pressure depressant additives forming approximately 1% by weight of said mixture.

5. A method of immobilizing radioactive particles comprising the steps of:

melting a mixture of a natural wax and a polyolefin that has a sufficiently low molecular weight to not char at the melting temperature of the mixture;

adding radioactive particles to said melted mixture; and solidifying said mixture.

6. The method of claim 5 in which the melting of said wax-polyolefin mixture comprises:

heating a wax that has a melting point between about 140° F and 170° F to about 200°–220° F; and adding either a polyethylene or polypropylene that is at least partially soluble in said liquefied wax, the mixture thereby being entirely liquefied at said temperature.

7. The method of claim 6 in which:

said melting of a wax-polyolefin mixture comprises melting a mixture of between about 60–90% wax and 10–40% of either polyethylene or polypropylene; and said adding of radioactive particles to said melted mixture comprises adding particles that are predried and pre-heated to a temperature between about 220°–350° F.

* * * * *